United States Patent [19]

Deibert

[11] 4,336,728

[45] Jun. 29, 1982

[54] PUSH-BUTTON REVERSIBLE RATCHET AND PAWL SOCKET WRENCH HANDLE

[76] Inventor: Raymond L. Deibert, 105 Milford Ave., Greenmount, Wilmington, Del. 19809

[21] Appl. No.: 195,186

[22] Filed: Oct. 8, 1980

[51] Int. Cl.[3] ..... B25B 13/46

[52] U.S. Cl. ..... 81/62; 192/43.1

[58] Field of Search ..... 81/61, 62, 63; 192/43.1

[56] References Cited

U.S. PATENT DOCUMENTS

| | | | |
|---|---|---|---|
| 484,288 | 10/1892 | Brolin | 81/62 |
| 633,880 | 9/1899 | Miller | 192/43.1 |
| 679,929 | 8/1901 | Webster | 81/63.1 |
| 685,698 | 10/1901 | Sprague | 192/43.1 |
| 791,298 | 5/1905 | Smith | 81/63.1 |
| 968,080 | 8/1910 | Repass | 81/63.1 |
| 1,078,059 | 11/1913 | Mossberg | 192/43.1 |
| 1,509,632 | 9/1924 | Bracci | 81/63 |
| 2,233,091 | 2/1941 | Becker | 81/62 |
| 2,531,722 | 11/1950 | Brubeck | 81/63 |
| 3,598,001 | 8/1971 | Thomasian | 81/63.1 |

*Primary Examiner*—James L. Jones, Jr.
*Attorney, Agent, or Firm*—Costas S. Krikelis

[57] ABSTRACT

A push-button operated reversible socket wrench ratchet and pawl mechanism which includes in addition to the conventional ratchet wheel and pivotably mounted pawl, an actuator and two cams; the actuator is driven by the cams to engage the pawl and ratchet and determine the direction of rotation of the wheel.

8 Claims, 8 Drawing Figures

PUSH-BUTTON REVERSIBLE RATCHET AND PAWL SOCKET WRENCH HANDLE

This invention concerns a ratchet and pawl mechanism and more particularly a reversible, push-button type ratchet and pawl socket wrench handle.

PRIOR ART

Ratchet and pawl mechanisms are well-known in the art, and their use in reversible socket wrench type handles dates at least as far back as the turn of the century. It is not surprising, therefore, that the development of such reversible handles has progressed to a high degree of technology and reliability and that high quality, reasonably priced reversible socket wrench handles are readily available in the market. The typical wrench handle exemplified by the drawings of U.S. Pat. No. 3,598,001 and FIG. 1 of this invention uses a generally crescent shaped pawl to selectively alternately engage a ratchet wheel and permit unidirectional rotation. The pawl is operated by a small lever on the top of the wrench handle, which is flipped using one's thumb over a small arc of circles to the right or left of the handle forcing one or the other side of the crescent shaped pawl in engagement with the ratchet wheel and determining the direction of rotation. The operation of this top-side located lever, however, presents some disadvantages where the tool is used in narrow spaces, upside down and generally where it is difficult for the operator to place his fingers over the top part of the wrench and flip the lever; in addition, when working blind, and upside down, it is sometimes extremely difficult to determine whether the lever is flipped to the "on" or "off" position and valuable time may be lost in determining which way the ratchet wrench will operate, resulting in operator frustration and possible injury.

There is need, therefore, for an improved wrench handle to alleviate the above problem, such as a ratchet wrench handle operated through a push-button actuator which would eliminate the confusion incident to the flip top-side lever. Early efforts as exemplified by U.S. Pat. No. 679,929 and U.S. Pat. No. 2,233,091 employed a pushtype actuator operated from the wrench sides to reverse direction. This, however, does not solve the problem of actuation in place by an operator in tight-space situations, as quite often there is no room for his hands to reach along the sides of the handle and depress the lever.

This invention alleviates the above problems through a reversible socket wrench hand tool comprising a body portion and a handle, a ratchet wheel within said body selectively engaged by a pivotably mounted pawl having a front and a rear surface to allow rotation of said ratchet wheel in one selectable direction only the improvement which comprises a pivotably mounted actuator having a resilient contact with the rear surface of said pawl and operated through at least one slideably mounted cam rod extending through said wrench body in the general direction of said wrench handle.

More specifically this invention resolves the above problems by using a cam rod operated, reversible ratchet and pawl mechanism in a reversible socket wrench handle which comprises:

- a ratchet wheel;
- a pivotably mounted pawl having a front end in contact with the ratchet wheel and a back end;

- a pivotably mounted actuator comprising at least two driving surfaces and a resiliently mounted pin in contact with the back end of the pawl, and
- at least two cam rods slideably mounted in the wrench handle extending through the top side of the handle, facing rearward, and engaging the driving surfaces on the actuator.

This arrangement provides for push-button type operation of the mechanism, where the operator may use his thumb to press one or the other protruding cams and lock the wrench in one or another mode of rotation.

BRIEF DESCRIPTION OF THE DRAWINGS

The operation of this device will be better understood with reference to the accompanying drawngs. Similar parts are indicated using same reference numbers.

Figure 1:
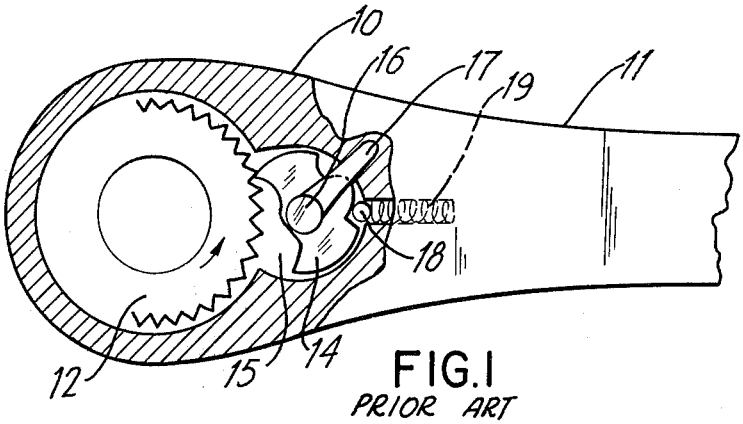
FIG. 1 PRIOR ART
FIG. 1 is a schematic representation of a typical commercial ratchet wrench employing the top-side lever.

With reference now to FIG. 1, commercial wrenches generally comprise a body portion 10 and a handle 11. Within the body portion, there is mounted a ratchet wheel 12. Behind the ratchet wheel, in a cavity 15 there is mounted pawl 14 which is operated through an actuating lever 17 protruding through the top of the wrench body 10. Pawl 14 is pivotably mounted in cavity 15 through a shaft 16 which may be integral with the pawl or a pin inserted through a hole in the pawl.

The front end of the pawl which engages the teeth of the ratchet wheel has a generally crescent shape providing two pointed ends. Depending on the position of the actuating lever, one or the other of the pointed ends is inserted between the teeth of the ratchet wheel.

The back end of the pawl is also shaped to provide two surfaces angled with respect to each other with the apex of the angle pointing toward the axis of the pivot shaft 16. The two surfaces are separated by a third surface having a generally convex shape. A ball 18 rides on the back end of the pawl and serves two purposes. It secures the orientation of the pawl, and it allows the pawl to pivot slightly to disengage the ratchet wheel teeth to permit rotation of the wheel in one direction as indicated by the arrow in FIG. 1. An effort to turn the wheel in the opposite direction tends to push the pointed end of pawl 14 into deeper engagement with the wheel teeth and prevent rotation.

Figure 2:
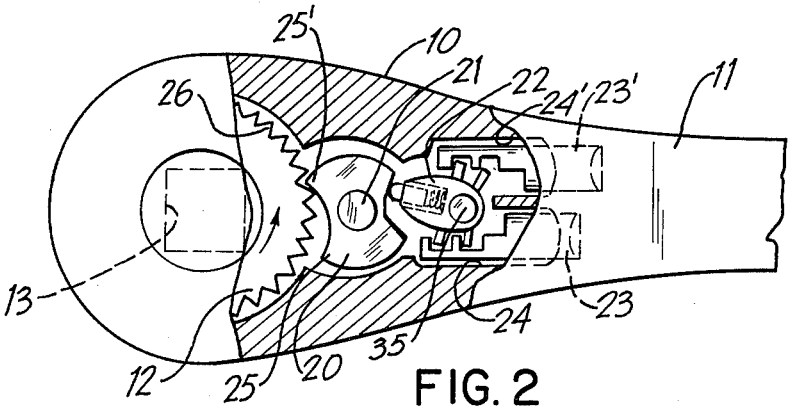
FIG. 2 is a top view of a wrench in accordance with the present invention showing the crescent-shaped pawl, actuator and cam rods.
Figure 3:
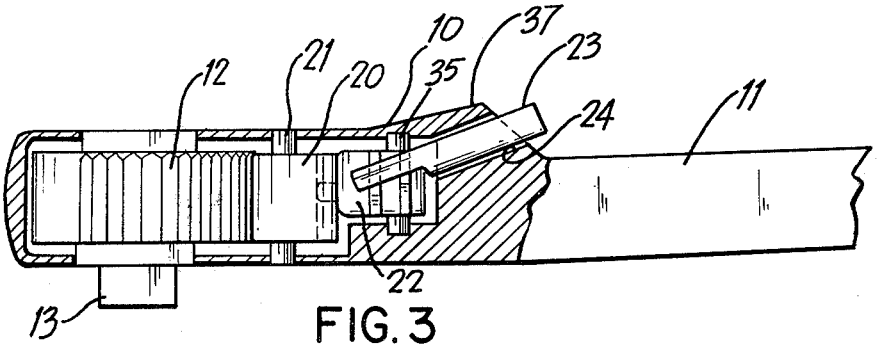
FIG. 3 is a side view of the device shown in FIG. 2, showing the location of the cam rods with respect to the body and handle of the wrench.
Figure 4:
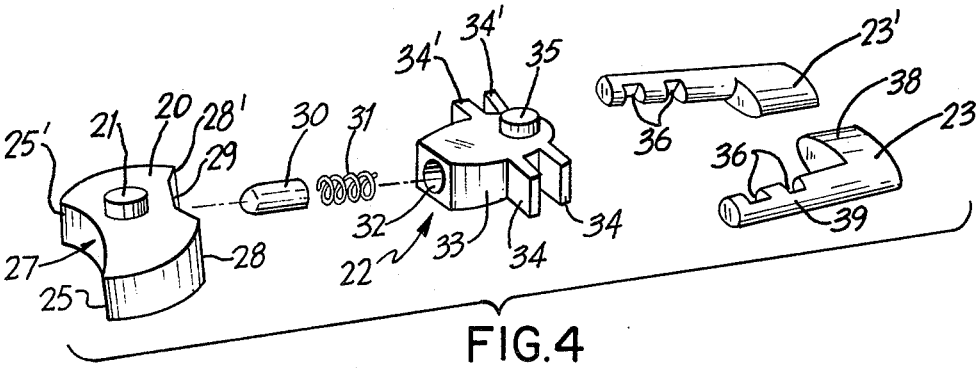
FIG. 4 is a blow-out detail of the pawl, actuator and cam rods arrangement.

In the preferred embodiment of the present invention, shown in FIGS. 2, 3 and 4, a ratchet wheel 12 similar to that of the prior art is used mounted in the body 10 of a reversible socket wrench. A key 13 is used to engage a multitude of wrench sockets as is well known.

Adjacent and behind the ratchet wheel 12 there is mounted a pawl 20 shown in detail in FIG. 4. This pawl 20 has a generally crescent-shaped front end 27 and a back end comprised of two generally flat surfaces 28 and 28' angled toward each other with the angle apex generally pointing toward the front end, the two surfaces separated by a third, convex surface 29. An integral shaft 21 is included as part of pawl 20. This shaft which extends both from the top and bottom of pawl 20 serves to both locate pawl 20 in the body 10 of the wrench and to provide the pivot axis for the operation of the pawl, as shown in FIG. 3. Referring back to FIG. 2, placed right behind pawl 20 there is an actuator 22 which serves to alternately push onto one or the other of surfaces 28 on the back of pawl 20 and force one or the other pointed end 25 of the crescent-shaped pawl into engagement with the ratchet wheel teeth 26.

The actuator is shown in greater detail in FIG. 4. It comprises a body portion 33 from which extend outwardly four tabs 34, 34'. It further comprises a pivot shaft 35 which serves a similar function as shaft 21 of pawl 20, and locates actuator 22 behind pawl 20, as well as provides the pivot axis for the operation of the actuator. The actuator further comprises a cavity 32 into which is mounted a compression spring 31 and a push pin 30. Push pin 30 presses against the back end of pawl 20 and rides on surfaces 28, 28' and 29.

Two cam rods 23 and 23' of a generally cylindrical shape are provided for the operation of actuator 22. The cam rods slide into two guide holes 24 and 24' in the body 10 of the wrench, and protrude through a hump 37 towards the rear, or handle portion 11 of the wrench. The cam rods in the preferred embodiment have a heavier portion 38 which protrudes through the wrench body and a narrow portion 39 into which there are cut two notches 36. The notch size is selected to match the actuator tab width, so that when the cam rods are mounted in holes 24, 24', the notches engage the tabs on the actuator 22. Thus pressure on one of the cam rods from the outside of the wrench body pushes the cam rod forward. For instance, when cam rod 23 is depressed, it forces the actuator to pivot through the application of off-center pressure through the tabs 34. As the actuator turns, tabs 34' push cam rod 23' outwardly.

Also as the actuator pivots, push pin 30 slides over surfaces 28 and 29 and applies pressure on surface 29'. This in turn engages crescent-pointed end 25' of pawl 20 with the teeth 26 of ratchet wheel 12. As the wheel rotates in the direction of the arrow in FIG. 2, teeth 26 push on the crescent surface of pawl 20 backwards and the motion is transmitted to push pin 30. Push pin 30 is resiliently mounted on actuator 22, and allows a limited amount of pivot motion to pawl 20, sufficient to let the ratchet-wheel teeth slip over the engaging end of pawl 20.

When the wheel is turned in the opposite direction, the teeth 26 tend to pull the engaging end 25 of pawl 20 deeper into the spaces between the teeth, preventing rotation of the wheel.

Depressing next cam rod 23', pivots actuator 22 and pushes cam rod 23 outwardly, while push pin 30 slides over the back end of pawl 20 to rest and press against surface 28. As a result, pawl 20 rotates and engages crescent end 25 with the ratchet wheel, reversing the direction of rotation of this wheel.

Figure 5:
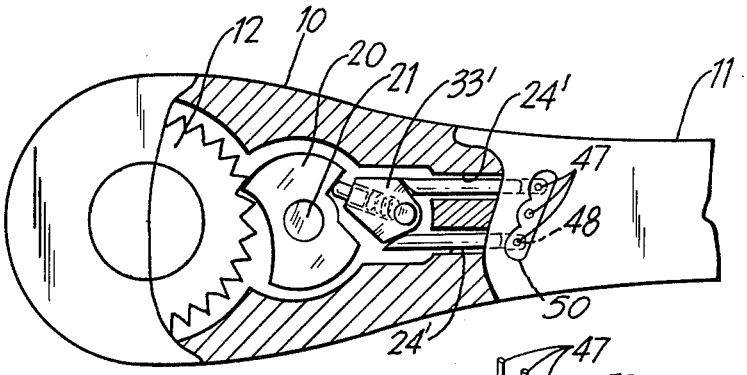
FIG. 5 is another embodiment in accordance with this invention.

FIG. 5 represents an alternate embodiment of this invention. The ratchet wheel and pawl 20 arrangement are identical as the arrangement described above. However, the actuator 33' differs in that instead of utilizing protruding tabs which mesh with notches or indentations on the cam rods to impart rotation to the actuator, the body of the actuator 33' is shaped to provide two angled driving surfaces 40 and 40' on either side of pivot shaft 35 which are engaged by the lower ends of cam rods 41. These ends may include an angular cut-off portion 42 and 42' which matches the angle of the driving surfaces. When this arrangement is employed, as it does not offer a provision for retaining the cam rods in the slots 24', a journaled link 50 may be provided, connecting the two cam rods, pivotably mounted on the wrench body 10 near the point where the body joins the handle 11. In this case, the cam rods may be simple cylindrical rods terminating into a short tab 44 having a hole 45. Corresponding holes 48 in the link 50 are provided, into which retaining pins 47 are inserted to form an articulated joint between the link and the cam rods, and between the link and the wrench body. In this manner, pressure on either end of the journaled link 50, depresses the cam rod, which bears on angled surface 40 rotating actuator 33' and in turn pivoting pawl 20 to selectively engage one or the other crescent ends of pawl 20 with the teeth of ratchet wheel 12 as described above.

Figure 6:
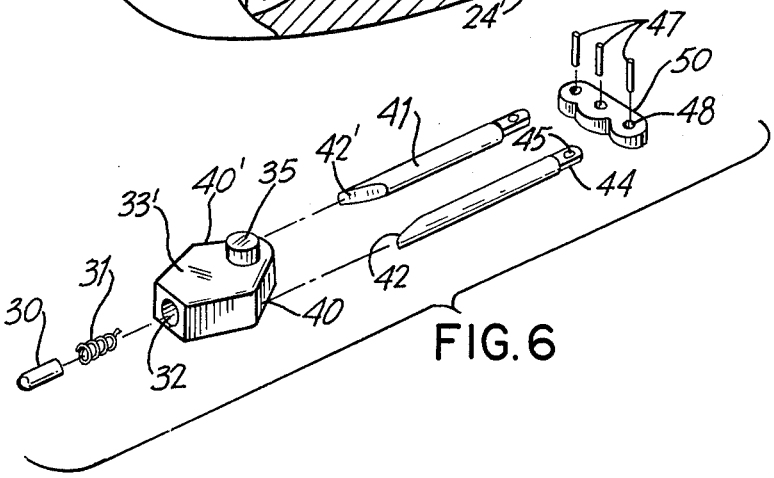
FIG. 6 is a blow-out detailed arrangement for the pawl, actuator and cam rods used in the embodiment of FIG. 5.
Figure 7:
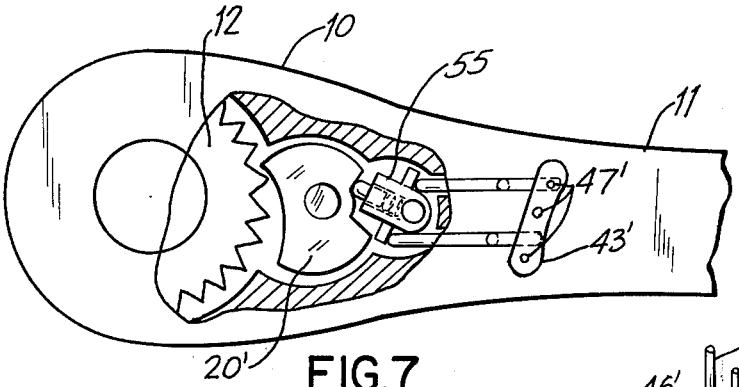
FIG. 7 is a schematic representation of still another embodiment of this invention.
Figure 8:
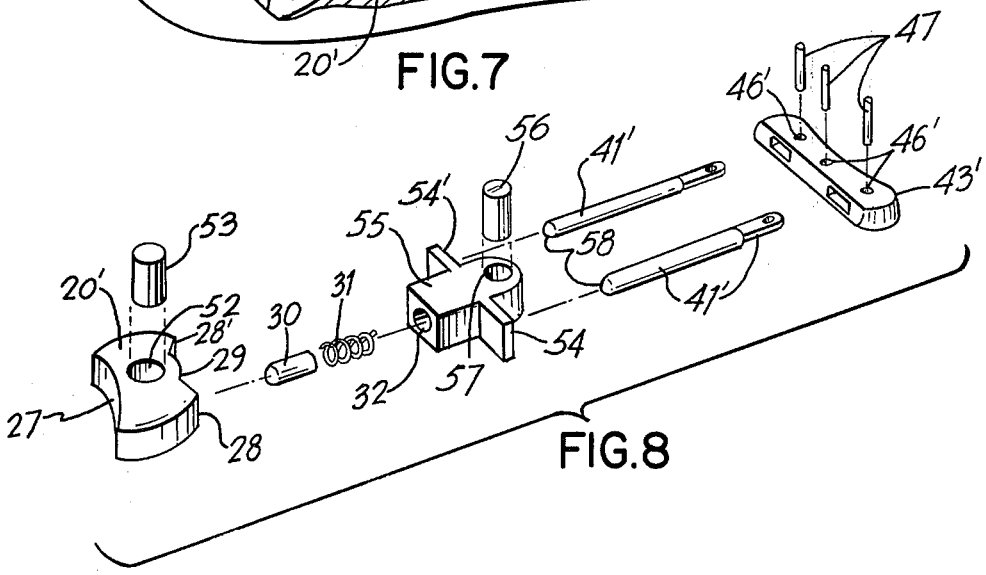
FIG. 8 is a blow-out detailed arrangement for the pawl, actuator and cam rods used in the embodiment of FIG. 7.

FIG. 7 shows yet another embodiment of this invention in which the actuator 55 offers two protruding tabs as an alternate to the angled bearing surfaces 40 shown in FIg. 6. In this instance, it is preferred that the cam rods 41' terminate in a rounded surface 58 for smoother engagement with the bearing surfaces 54 and 54'. A connecting link 43' having substantially the same structure as that of the link of FIG. 6 is employed, utilizing pins 47' and holes 46' to provide journaled connection with the cam rod tabs 41'.

FIG. 7 further shows the use of a pivot shaft 56 inserted in a hole 57 in the actuator to provide for positioning of the actuator in the body of the wrench, and to allow the actuator to pivot. A similar pin 53 and hole 52 may be used to mount the pawl in the body of the wrench.

While an effort has been made to illustrate various means to pivotably mount the actuator and pawl in the wrench body, such illustrations are not limiting, and it is within the scope of this invention to use any other means known in the art to provide for a similar mount, as for instance fixed stubs on the wrench body which may engage depressions on the actuator or pawl. Finally, while the back end of the pawl is shown to comprise two angled flat surfaces separated by a convex surface, the surfaces may be separated by a combination of two smaller angled surfaces forming an angle with the apex facing towards the rear of the pawl providing a more positive, click-type lock as the pin 30 flips from engagement with one of the two surfaces 28 to the other.

Having thus described the present invention, I claim:

1. A cam rod operated reversible ratchet and pawl for use in a reversible socket wrench handle comprising:

a ratchet wheel;

a pivotably mounted pawl having a front end in contact with said ratchet wheel and a back end;

a pivotably mounted actuator comprising at least one driving surface and a resiliently mounted pin in contact with said back end of the pawl, and at least two cam rods slideably mounted in said wrench handle, extending through said handle and engaging the driving surface on the actuator.

2. A reversible ratchet and pawl according to claim 1 wherein the front end of said pawl has a generally crescent shape terminating into two points and where each of said points selectively engages said ratchet wheel to permit motion in one direction only, said direction being determined by the engaging point.

3. A reversible ratchet and pawl according to claim 2 wherein the back end of said pawl comprises at least two flat surfaces angled with respect to each other with the angle apex toward the front end of the pawl and wherein said flat surfaces are separated by a third, generally curvilinear convex surface.

4. A reversible ratchet and pawl according to any one of claims 1, 2 or 3 wherein the resiliently mounted pin in the actuator is spring loaded and rides in contact with said flat and curvilinear surfaces on the back end of the pawl.

5. A reversible ratchet and pawl according to claim 4 wherein said driving surfaces on the actuator comprise at least two tabs extending out from and on opposite sides of the actuator.

6. A ratchet and pawl mechanism according to claim 4 wherein said driving surfaces on the actuator comprise at least 4 tabs extending out from and on opposite sides of the actuator.

7. A ratchet and pawl mechanism according to claim 4 further comprising a pivotably mounted arm connecting said cam rods through rotatable joints and being further fixed at its mid-point between said cam rods through a rotatable joint to said ratchet handle.

8. A ratchet and pawl mechanism according to claim 5 wherein said cam rods comprise at least one notch each at one end in engagement with said tabs whereby forward movement of one of the cam rods pivots the actuator and results in rearward movement of the other cam rod.

* * * * *